US009322257B2

(12) United States Patent
Parsche

(10) Patent No.: US 9,322,257 B2
(45) **Date of Patent: *Apr. 26, 2016**

(54) RADIO FREQUENCY HEAT APPLICATOR FOR INCREASED HEAVY OIL RECOVERY

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/301,887

(22) Filed: Jun. 11, 2014

(65) Prior Publication Data

US 2014/0290934 A1 Oct. 2, 2014

Related U.S. Application Data

(62) Division of application No. 12/886,338, filed on Sep. 20, 2010, now Pat. No. 8,789,599.

(51) Int. Cl.
*E21B 43/24* (2006.01)
*H01Q 1/04* (2006.01)
(Continued)

(52) U.S. Cl.
CPC ..... *E21B 43/2401* (2013.01); *E21B 41/00* (2013.01); *H01Q 1/04* (2013.01); *H01Q 9/24* (2013.01); *H05B 6/62* (2013.01); *H05B 2214/03* (2013.01); *Y10T 29/49826* (2015.01); *Y10T 29/53* (2015.01)

(58) Field of Classification Search
None
See application file for complete search history.

(56) References Cited

U.S. PATENT DOCUMENTS 2,371,459 A 3/1945 Mittelmann
2,685,930 A 8/1954 Albaugh
(Continued)

FOREIGN PATENT DOCUMENTS

CA 1199573 1/1986
CA 2678473 8/2009
(Continued)

OTHER PUBLICATIONS

Chute, F.S., Vermeulen, F.E., Cervenan, M.R. And McVea, F.J., "Electrical Properties of Athabasca Oil Sands", Canadian Journal of Earth Science, 16, 1979, pp. 2009-2021.
(Continued)

*Primary Examiner* — Elizabeth Gitlin
(74) *Attorney, Agent, or Firm* — Allen, Dyer, Doppelt, Milbrath & Gilchrist, P.A.

(57) ABSTRACT

A radio frequency applicator and method for heating a geological formation is disclosed. A radio frequency source configured to apply a differential mode signal is connected to a coaxial conductor including an outer conductor pipe and an inner conductor. The inner conductor is coupled to a second conductor pipe through one or more metal jumpers. One or more current chokes, such as a common mode choke or antenna balun, are installed around the outer conductor pipe and the second conductor pipe to concentrate electromagnetic radiation within a hydrocarbon formation. The outer conductor pipe and the second conductor pipe can be traditional well pipes for extracting hydrocarbons, such as a steam pipe and an extraction pipe of a steam assisted gravity drainage (SAGD) system. An apparatus and method for installing a current choke are also disclosed.

13 Claims, 9 Drawing Sheets

(51) Int. Cl.

| | |
|---|---|
| ***H01Q 9/24*** | (2006.01) |
| ***H05B 6/62*** | (2006.01) |
| ***E21B 41/00*** | (2006.01) |

(56) References Cited

U.S. PATENT DOCUMENTS

| | | | | |
|---|---|---|---|---|
| 3,497,005 | A | 2/1970 | Pelopsky | |
| 3,848,671 | A | 11/1974 | Kern | |
| 3,954,140 | A | 5/1976 | Hendrick | |
| 3,988,036 | A | 10/1976 | Fisher | |
| 3,991,091 | A | 11/1976 | Driscoll | |
| 4,035,282 | A | 7/1977 | Stuchberry et al. | |
| 4,042,487 | A | 8/1977 | Seguchi | |
| 4,087,781 | A | 5/1978 | Grossi et al. | |
| 4,136,014 | A | 1/1979 | Vermeulen | |
| 4,140,179 | A | 2/1979 | Kasevich et al. | |
| 4,140,180 | A | 2/1979 | Bridges et al. | |
| 4,144,935 | A | 3/1979 | Bridges | |
| 4,146,125 | A | 3/1979 | Sanford et al. | |
| 4,196,329 | A | 4/1980 | Rowland et al. | |
| 4,295,880 | A | 10/1981 | Horner | |
| 4,300,219 | A | 11/1981 | Joyal | |
| 4,301,865 | A | 11/1981 | Kasevich et al. | |
| 4,328,324 | A | 5/1982 | Kock | |
| 4,373,581 | A | 2/1983 | Toellner | |
| 4,396,062 | A | 8/1983 | Iskander | |
| 4,404,123 | A | 9/1983 | Chu | |
| 4,410,216 | A | 10/1983 | Allen | |
| 4,425,227 | A | 1/1984 | Smith | |
| 4,449,585 | A | 5/1984 | Bridges et al. | |
| 4,456,065 | A | 6/1984 | Heim | |
| 4,457,365 | A | 7/1984 | Kasevich et al. | |
| 4,470,459 | A | 9/1984 | Copland | |
| 4,485,869 | A | 12/1984 | Sresty | |
| 4,487,257 | A | 12/1984 | Dauphine | |
| 4,508,168 | A | 4/1985 | Heeren | |
| 4,514,305 | A | 4/1985 | Filby | |
| 4,524,827 | A | 6/1985 | Bridges | |
| 4,531,468 | A | 7/1985 | Simon | |
| 4,583,586 | A | 4/1986 | Fujimoto et al. | |
| 4,620,593 | A | 11/1986 | Haagensen | |
| 4,622,496 | A | 11/1986 | Dattili | |
| 4,645,585 | A | 2/1987 | White | |
| 4,678,034 | A | 7/1987 | Eastlund | |
| 4,703,433 | A | 10/1987 | Sharrit | |
| 4,790,375 | A | 12/1988 | Bridges | |
| 4,817,711 | A | 4/1989 | Jeambey | |
| 4,882,984 | A | 11/1989 | Eves, II | |
| 4,892,782 | A | 1/1990 | Fisher et al. | |
| 5,046,559 | A | 9/1991 | Glandt | |
| 5,055,180 | A | 10/1991 | Klaila | |
| 5,065,819 | A | 11/1991 | Kasevich | |
| 5,082,054 | A | 1/1992 | Kiamanesh | |
| 5,136,249 | A | 8/1992 | White | |
| 5,199,488 | A | 4/1993 | Kasevich | |
| 5,233,306 | A | 8/1993 | Misra | |
| 5,236,039 | A | 8/1993 | Edelstein | |
| 5,251,700 | A | 10/1993 | Nelson | |
| 5,293,936 | A | 3/1994 | Bridges | |
| 5,304,767 | A | 4/1994 | MacGaffigan | |
| 5,315,561 | A | 5/1994 | Grossi | |
| 5,370,477 | A | 12/1994 | Bunin | |
| 5,378,879 | A | 1/1995 | Monovoukas | |
| 5,484,985 | A * | 1/1996 | Edelstein et al. | 219/772 |
| 5,506,592 | A | 4/1996 | MacDonald | |
| 5,582,854 | A | 12/1996 | Nosaka | |
| 5,621,844 | A * | 4/1997 | Bridges | 392/301 |
| 5,631,562 | A | 5/1997 | Cram | |
| 5,746,909 | A | 5/1998 | Calta | |
| 5,910,287 | A | 6/1999 | Cassin | |
| 5,923,299 | A | 7/1999 | Brown et al. | |
| 6,045,648 | A | 4/2000 | Palmgren et al. | |
| 6,046,464 | A | 4/2000 | Schetzina | |
| 6,055,213 | A | 4/2000 | Rubbo | |
| 6,063,338 | A | 5/2000 | Pham | |
| 6,097,262 | A | 8/2000 | Combellack | |
| 6,106,895 | A | 8/2000 | Usuki | |
| 6,112,273 | A | 8/2000 | Kau | |
| 6,184,427 | B1 | 2/2001 | Klepfer | |
| 6,229,603 | B1 | 5/2001 | Coassin | |
| 6,232,114 | B1 | 5/2001 | Coassin | |
| 6,301,088 | B1 | 10/2001 | Nakada | |
| 6,303,021 | B2 | 10/2001 | Winter | |
| 6,348,679 | B1 | 2/2002 | Ryan et al. | |
| 6,360,819 | B1 | 3/2002 | Vinegar | |
| 6,432,365 | B1 | 8/2002 | Levin | |
| 6,603,309 | B2 | 8/2003 | Forgang | |
| 6,613,678 | B1 | 9/2003 | Sakaguchi | |
| 6,614,059 | B1 | 9/2003 | Tsujimura | |
| 6,649,888 | B2 | 11/2003 | Ryan et al. | |
| 6,712,136 | B2 | 3/2004 | De Rouffignac | |
| 6,808,935 | B2 | 10/2004 | Levin | |
| 6,923,273 | B2 | 8/2005 | Terry | |
| 6,932,155 | B2 | 8/2005 | Vinegar | |
| 6,967,589 | B1 | 11/2005 | Peters | |
| 6,992,630 | B2 | 1/2006 | Parsche | |
| 7,046,584 | B2 | 5/2006 | Sorrells | |
| 7,079,081 | B2 | 7/2006 | Parsche et al. | |
| 7,091,460 | B2 | 8/2006 | Kinzer | |
| 7,109,457 | B2 | 9/2006 | Kinzer | |
| 7,115,847 | B2 | 10/2006 | Kinzer | |
| 7,147,057 | B2 | 12/2006 | Steele | |
| 7,172,038 | B2 | 2/2007 | Terry | |
| 7,205,947 | B2 | 4/2007 | Parsche | |
| 7,312,428 | B2 | 12/2007 | Kinzer | |
| 7,322,416 | B2 | 1/2008 | Burris, II | |
| 7,337,980 | B2 | 3/2008 | Schaedel | |
| 7,438,807 | B2 | 10/2008 | Garner et al. | |
| 7,441,597 | B2 | 10/2008 | Kasevich | |
| 7,461,693 | B2 | 12/2008 | Considine et al. | |
| 7,484,561 | B2 | 2/2009 | Bridges | |
| 7,562,708 | B2 | 7/2009 | Cogliandro | |
| 7,623,804 | B2 | 11/2009 | Sone | |
| 8,136,594 | B2 * | 3/2012 | Streich | C09K 8/42 166/292 |
| 8,646,527 | B2 | 2/2014 | Trautman | |
| 2002/0032534 | A1 | 3/2002 | Regier | |
| 2004/0031731 | A1 | 2/2004 | Honeycutt | |
| 2004/0084184 | A1 * | 5/2004 | Orban et al. | 166/292 |
| 2005/0199386 | A1 | 9/2005 | Kinzer | |
| 2005/0274513 | A1 | 12/2005 | Schultz | |
| 2006/0038083 | A1 | 2/2006 | Criswell | |
| 2007/0108202 | A1 | 5/2007 | Kinzer | |
| 2007/0131591 | A1 | 6/2007 | Pringle | |
| 2007/0137852 | A1 | 6/2007 | Considine et al. | |
| 2007/0137858 | A1 | 6/2007 | Considine et al. | |
| 2007/0187089 | A1 | 8/2007 | Bridges | |
| 2007/0261844 | A1 | 11/2007 | Cogliandro et al. | |
| 2008/0073079 | A1 | 3/2008 | Tranquilla | |
| 2008/0143330 | A1 | 6/2008 | Madio | |
| 2009/0009410 | A1 | 1/2009 | Dolgin et al. | |
| 2009/0050318 | A1 | 2/2009 | Kasevich | |
| 2009/0242196 | A1 | 10/2009 | Pao | |
| 2012/0067580 | A1 | 3/2012 | Parsche | |

FOREIGN PATENT DOCUMENTS

| | | |
|---|---|---|
| DE | 102008022176 | 11/2009 |
| EP | 0135966 | 4/1985 |
| EP | 0418117 | 3/1991 |
| EP | 0563999 | 10/1993 |
| EP | 1106672 | 6/2001 |
| FR | 1586066 | 2/1970 |
| FR | 2925519 | 6/2009 |
| GB | 2341442 | 3/2000 |
| JP | 56050119 | 5/1981 |
| JP | 2246502 | 10/1990 |
| JP | 11325376 | 11/1999 |
| WO | 2007133461 | 11/2007 |
| WO | 2008011412 | 1/2008 |
| WO | 2008030337 | 3/2008 |
| WO | 2008098850 | 8/2008 |

(56) References Cited

FOREIGN PATENT DOCUMENTS

| | | |
|---|---|---|
| WO | 2009027262 | 8/2008 |
| WO | 2009114934 | 9/2009 |

OTHER PUBLICATIONS

Davidson, R.J., "Electromagnetic Stimulation of Lloydminster Heavy Oil Reservoirs", Journal of Canadian Petroleum Technology, 34(4), 1995, pp. 15-24.

Hu, Y., Jha, K.N. and Chakma, A., "Heavy-Oil Recovery from Thin Pay Zones by Electromagnetic Heating", Energy Sources, 21(1-2), 1999, pp. 63-73.

Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994, pp. 1-15.

Koolman, M., Huber, N., Diehl, D. and Wacker, B., "Electromagnetic Heating Method to Improve Steam Assisted /N. B./ 23 Gravity Drainage", SPE117481, presented at the 2008 SPE International Thermal Operations and Heavy Oil Symposium held in Calgary, Alberta, Canada, Oct. 20-23, 2008, pp. 1-13.

Kovaleva, L.A., Nasyrov, N. M. and Khaidar, A.M., Mathematical Modelling of High-Frequency Electromagnetic Heating of the Bottom-Hole Area of Horizontal Oil Wells, Journal of Engineering Physics and Thermo Physics, 77(6), 2004, pp. 1184-1191.

McGee, B.C.W. And Donaldson, Rd., "Heat Transfer Fundamentals for Electro-thermal Heating of Oil Reservoirs", CIPC 2009-024, presented at the Canadian International Petroleum Conference, held in Calgary, Alberta, Canada, Jun. 16-18, 2009, pp. 1-16.

Ovalles, C., Fonseca, A., Lara, A., Alvarado, V., Urrecheaga, K., Ranson, A. and Mendoza, H., "Opportunities of Downhole Dielectric Heating in Venezuela: Three Case Studies Involving Medium, Heavy and Extra-Heavy Crude Oil D Reservoirs" SPE78980, presented at the 2002 SPE International Thermal Operations and Heavy Oil Symposium and International Horizontal Well Technology Conference held in Calgary, Alberta, Canada, Nov. 4-7, 2002, pp. 1-10.

Rice, S.A., Kok, A.L. and Neate, C.J., "A Test of the Electric Heating Process as a Means of Stimulating the 27 Productivity of an Oil Well in the Schoonebeek Field", CIM 92-04 presented at the CIM 1992 Annual Technical Conference in Calgary, Jun. 7-10, 1992, pp. 1-16.

Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000, pp. 1-10.

Sayakhov, F.L., Kovaleva, L.A. and Nasyrov, N. M., "Special Features of Heat and Mass Exchange in the Face Zone of /N.B./ 29 Boreholes upon Injection of a Solvent with a Simultaneous Electromagnetic Effect", Journal of Engineering Physics and Thermophysics, 71(1), 1998, pp. 161-165.

Spencer, H.L., Bennett, K.A. and Bridges, J.E. "Application of the IITRI/Uentech Electromagnetic Stimulation Process iN.B.i 30 to Canadian Heavy Oil Reservoirs" Paper 42, Fourth International Conference on Heavy Oil Crude and Tar Sands, UNITARIUNDP, Edmonton, Alberta, Canada, Aug. 7-12, 1988, pp. 1-8.

Sresty, G.C., Dev, H., Snow, R.N. and Bridges, J.E., "Recovery of Bitumen from Tar Sand Deposits with the Radio Frequency Process", SPE Reservoir Engineering, Jan. 1986, pp. 85-94.

Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 2000, pp. 25-29.

Schelkunoff, S.K. and Friis, H.T., "Antennas: Theory and Practice", John Wiley & Sons, Inc., London, Chapman Hall, Limited, 1952, pp. 229-244, 351-353.

Gupta, S.C., Gittins, S.D., "Effect of Solvent Sequencing and Other Enhancement on Solvent Aided Process", Journal of Canadian Petroleum Technology, vol. 46, No. 9, Sep. 2007, pp. 57-61.

PCT Notification of Transmittal of the International Search Report and the Written Opinion of the International Searching Authority, or the Declaration, in PCT/US2010/025761, dated Feb. 9, 2011, pp. 1-13.

PCT Notification of Transmittal of the International Search Report and The Written Opinion of the International Searching Authority, or the Declaration, in PCT/US2010/057090, dated Mar. 3, 2011, pp. 1-10.

"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm), pp. 1-13.

Von Hippel, Arthur R., Dielectrics and Waves, Copyright 1954, Library of Congress Catalog Card No. 54-11020, Contents, pp. xi-xii; Chapter II, Section 17, "Polyatomic Molecules", Appendix C-E, New York, John Wiley and Sons, pp. 150-155, pp. 273-277.

United States Patent and Trademark Office, Non-final Office action issued in U.S. Appl. No. 12/396,247, dated Mar. 28, 2011, pp. 1-10.

United States Patent and Trademark Office, Non-final Office action issued in U.S. Appl. No. 12/396,284, dated Apr. 26, 2011, pp. 1-62.

Patent Cooperation Treaty, Notification of Transmittal of the International Search Report and The Written Opinion of the International Searching Authority, or the Declaration, in PCT/US201 0/025808, dated Apr. 5, 2011, pp. 1-12.

Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada, pp. 1-14.

Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of The Institution of Electrical Engineers,© 1986, pp. 1-57.

Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of The Institution of Electrical Engineers,© 1986. pp. 1-10.

"Oil sands." Wikipedia, the free encyclopedia. Retrieved from the Internet from: http://en.wikipedia.org/w/index.php? title=Oil_sands& printable=yes, Feb. 16, 2009, pp. 1-14.

Sahni et al., "Electromagnetic Heating Methods for Heavy Oil Reservoirs." 2000 Society of Petroleum Engineers SPE/AAPG Western Regional Meeting, Jun. 19-23, 2000, pp. 1-12.

Power et al., "Froth Treatment: Past, Present & Future." Oil Sands Symposium, University of Alberta, May 3-5, 2004, pp. 1-29.

Flint, "Bitumen Recovery Technology a Review of Long Term R&D Opportunities." Jan. 31, 2005. LENEF Consulting (1994) Limited, Part 1, 100 pgs; Part 2, 110 pgs.

"Froth Flotation." Wikipedia, the free encyclopedia. Retrieved from the internet from: http://en.wikipedia.org/wiki/Froth_flotation, Apr. 7, 2009, pp. 1-6.

"Relative static permittivity." Wikipedia, the free encyclopedia. Retrieved from the Internet from http://en.wikipedia.org/w/index/php?title=Relative_static_permittivity&printable=yes, Feb. 12, 2009, pp. 1-3.

"Tailings." Wikipedia, the free encyclopedia. Retrieved from the Internet from http://en.wikipedia.org/w/index.php? title=Tailings& printable=yes, Feb. 12, 2009, pp. 1-6.

"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.

Burnhan, "Slow Radio-Frequency Processing of Large Oil Shale Volumes To Produce Petroleum-like Shale Oil," U. S. Department of Energy, Lawrence Livermore National Laboratory, Aug. 20, 2003, UCRL-ID-155045, pp. 1-17.

Sahni et al., "Electromagnetic Heating Methods for Heavy Oil Reservoirs," U.S. Department of Energy, Lawrence Livermore National Laboratory, May 1, 2000, UCL-JC-138802, pp. 1-10.

(56) References Cited

OTHER PUBLICATIONS

Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007, pp. 1-9.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
Kinzer, A Review of Notable Intellectual Property for In Situ Electromagnetic Heating of Oil Shale, Quasar Energy LLC, p. 1.
A. Godio: "Open ended-coaxial Cable Measurements of Saturated Sandy Soils", American Journal of Environmental Sciences, vol. 3, No. 3, 2007, , XP002583544, pp. 175-182.
Carlson et al., "Development of the IIT Research Institute RF Heating Process for In Situ Oil Shale/Tar Sand Fuel Extraction—An Overview", Apr. 1981, pp. 1-9.
PCT International Search Report and Written Opinion in PCT/US2010/025763, Jun. 4, 2010, pp. 1-15.
PCT International Search Report and Written Opinion in PCT/US2010/025807, Jun. 17, 2010, pp. 1-15.
PCT International Search Report and Written Opinion in PCT/US2010/025804, Jun. 30, 2010, pp. 1-15.
PCT International Search Report and Written Opinion in PCT/US2010/025769, Jun. 10, 2010, pp. 1-15.
PCT International Search Report and Written Opinion in PCT/US2010/025765, Jun. 30, 2010, pp. 1-11.
PCT International Search Report and Written Opinion in PCT/US2010/025772, Aug. 9, 2010, pp. 1-16.
Butler, R.M. "Theoretical Studies on the Gravity Drainage of Heavy Oil During In-Situ Steam Heating", Can J. Chern Eng, vol. 59,1981, pp. 1-6.
Butler, R. and Mokrys, 1., "A New Process (VAPEX) for Recovering Heavy Oils Using Hot Water and Hydrocarbon Vapour", Journal of Canadian Petroleum Technology, 30(1), 1991, pp. 97-106.
Butler, R. and Mokrys, 1., "Recovery of Heavy Oils Using Vapourized Hydrocarbon Solvents: Further Development of the VAPEX Process", Journal of Canadian Petroleum Technology, 32(6), 1993, pp. 56-62.
Butler, R. and Mokrys, 1., "Closed Loop Extraction Method for the Recovery of Heavy Oils and Bitumens Underlain by Aquifers: the VAPEX Process", Journal of Canadian Petroleum Technology, 37(4), 1998, pp. 41-50.
Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995, pp. 1-16.
Das, S.K. and Butler, R.M., "Diffusion Coefficients of Propane and Butane in Peace River Bitumen" Canadian Journal of Chemical Engineering, 74,988-989, Dec. 1996 pp. 1-8.
Das, S.K. and Butler, R.M., "Mechanism of the Vapour Extraction Process for Heavy Oil and Bitumen", Journal of Petroleum Science and Engineering, 21, 1998, pp. 43-59.
Dunn, S.G., Nenniger, E. and Rajan, R., "A Study of Bitumen Recovery by Gravity Drainage Using Low Temperature Soluble Gas Injection", Canadian Journal of Chemical Engineering, 67, Dec. 1989, pp. 978-991.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 1998, pp. 17-24.
Mokrys, I., and Butler, R., "In Situ Upgrading of Heavy Oils and Bitumen by Propane Deasphalting: the VAPEX 11 Process", SPE 25452, presented at the SPE Production Operations Symposium held in Oklahoma City OK USA, D Mar. 21-23, 1993, pp. 1-16.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008, pp. 1-14.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta D Canada, Jun. 16-18, 2009, pp. 1-16.
Bridges, J.E., Sresty, G.C., Spencer, H.L. and Wattenbarger, R.A., "Electromagnetic Stimulation of Heavy Oil Wells", 14, Third International Conference on Heavy Oil Crude and Tar Sands, UNITAR/UNDP, Long Beach D California, USA Jul. 22-31, 1985, pp. 1221-1232.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008, p. 1.
Carrizales, M. and Lake, L.W., "Two-Dimensional COMSOL Simulation of Heavy-Oil Recovery by Electromagnetic Heating", Proceedings of the COMSOL Conference Boston, 2009, pp. 1-7.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992, pp. 1-10.
Chhetri, A.B. and Islam, M.R., "A Critical Review of Electromagnetic Heating for Enhanced Oil Recovery", Petroleum Science and Technology, 26(14), 2008, pp. 1619-1631.

* cited by examiner

RADIO FREQUENCY HEAT APPLICATOR FOR INCREASED HEAVY OIL RECOVERY

CROSS REFERENCE TO RELATED APPLICATIONS

This specification is related to U.S. patent application Ser. No. 12/886,304 filed Sep. 20, 2010, now U.S. patent No. 8,646,527 issued Feb. 11, 2014, the entire contents of which are herein incorporated by reference.

BACKGROUND OF THE INVENTION

The present invention relates to heating a geological formation for the extraction of hydrocarbons, which is a method of well stimulation. In particular, the present invention relates to an advantageous radio frequency (RF) applicator and method that can be used to heat a geological formation to extract heavy hydrocarbons.

As the world's standard crude oil reserves are depleted, and the continued demand for oil causes oil prices to rise, oil producers are attempting to process hydrocarbons from bituminous ore, oil sands, tar sands, oil shale, and heavy oil deposits. These materials are often found in naturally occurring mixtures of sand or clay. Because of the extremely high viscosity of bituminous ore, oil sands, oil shale, tar sands, and heavy oil, the drilling and refinement methods used in extracting standard crude oil are typically not available. Therefore, recovery of oil from these deposits requires heating to separate hydrocarbons from other geologic materials and to maintain hydrocarbons at temperatures at which they will flow.

Current technology heats the hydrocarbon formations through the use of steam. Steam has been used to provide heat in-situ, such as through a steam assisted gravity drainage (SAGD) system.

A list of possibly relevant patents and literature follows:

| | |
|---|---|
| US 2007/0261844 | Cogliandro et al. |
| US 2008/0073079 | Tranquilla et al. |
| 2,685,930 | Albaugh |
| 3,954,140 | Hendrick |
| 4,140,180 | Bridges et al. |
| 4,144,935 | Bridges et al. |
| 4,328,324 | Kock et al. |
| 4,373,581 | Toellner |
| 4,410,216 | Allen |
| 4,457,365 | Kasevich et al. |
| 4,485,869 | Sresty et al. |
| 4,508,168 | Heeren |
| 4,524,827 | Bridges et al. |
| 4,620,593 | Haagensen |
| 4,622,496 | Dattilo et al. |
| 4,678,034 | Eastlund et al. |
| 4,790,375 | Bridges et al. |
| 5,046,559 | Glandt |
| 5,082,054 | Kiamanesh |
| 5,236,039 | Edelstein et al. |
| 5,251,700 | Nelson et al. |
| 5,293,936 | Bridges |
| 5,370,477 | Bunin et al. |
| 5,621,844 | Bridges |
| 5,910,287 | Cassin et al. |
| 6,046,464 | Schetzina |
| 6,055,213 | Rubbo et al. |
| 6,063,338 | Pham et al. |
| 6,112,273 | Kau et al. |
| 6,229,603 | Coassin, et al. |
| 6,232,114 | Coassin, et al. |
| 6,301,088 | Nakada |
| 6,360,819 | Vinegar |
| 6,432,365 | Levin et al. |
| 6,603,309 | Forgang, et al. |

-continued

| | |
|---|---|
| 6,613,678 | Sakaguchi et al. |
| 6,614,059 | Tsujimura et al. |
| 6,712,136 | de Rouffignac et al. |
| 6,808,935 | Levin et al. |
| 6,923,273 | Terry et al. |
| 6,932,155 | Vinegar et al. |
| 6,967,589 | Peters |
| 7,046,584 | Sorrells et al. |
| 7,109,457 | Kinzer |
| 7,147,057 | Steele et al. |
| 7,172,038 | Terry et al |
| 7,322,416 | Burris, II et al. |
| 7,337,980 | Schaedel et al. |
| US2007/0187089 | Bridges |
| Development of the IIT Research Institute RF Heating Process for In Situ Oil Shale/Tar Sand Fuel Extraction - An Overview | Carlson et al. |

SUMMARY OF THE INVENTION

An aspect of at least one embodiment of the present invention is a radio frequency (RF) applicator. The applicator includes a coaxial conductor including an inner conductor and an outer conductor pipe, a second conductor pipe, a RF source, a current choke, and a jumper that connects the inner conductor to the second conductor pipe. The RF source is configured to apply a differential mode signal with a wavelength to the coaxial conductor. A current choke surrounds the outer conductor pipe and the second conductor pipe and is configured to choke current flowing along the outside of the outer conductor pipe and the second conductor pipe.

Another aspect of at least one embodiment of the present invention involves a method for heating a geologic formation to extract hydrocarbons including several steps. A coaxial conductor is provided including an inner conductor and an outer conductor pipe. A second conductor pipe is provided as well. The inner conductor is coupled to the second conductor pipe. A current choke positioned to choke current flowing along the outer conductor pipe is provided. A differential mode signal is applied to the coaxial conductor.

Yet another aspect of at least one embodiment of the present invention involves an apparatus for installing a current choke. The apparatus includes a tube containing at least one perforation, and a plug located in the tube beyond at least one perforation. A charge of magnetic medium located at least partially within the tube and adjacent to at least one perforation. A piston is also located in the tube and adjacent to the charge of magnetic medium.

Yet another aspect of at least one embodiment of the present invention involves a method for installing a choke including several steps. A charge of magnetic medium is placed in a tube that has at least one perforation. The charge of magnetic medium is pushed out through at least one perforation.

Other aspects of the invention will be apparent from this disclosure.

DETAILED DESCRIPTION OF THE PREFERRED EMBODIMENTS

The subject matter of this disclosure will now be described more fully, and one or more embodiments of the invention are shown. This invention may, however, be embodied in many different forms and should not be construed as limited to the embodiments set forth herein. Rather, these embodiments are examples of the invention, which has the full scope indicated by the language of the claims.

Figure 1:
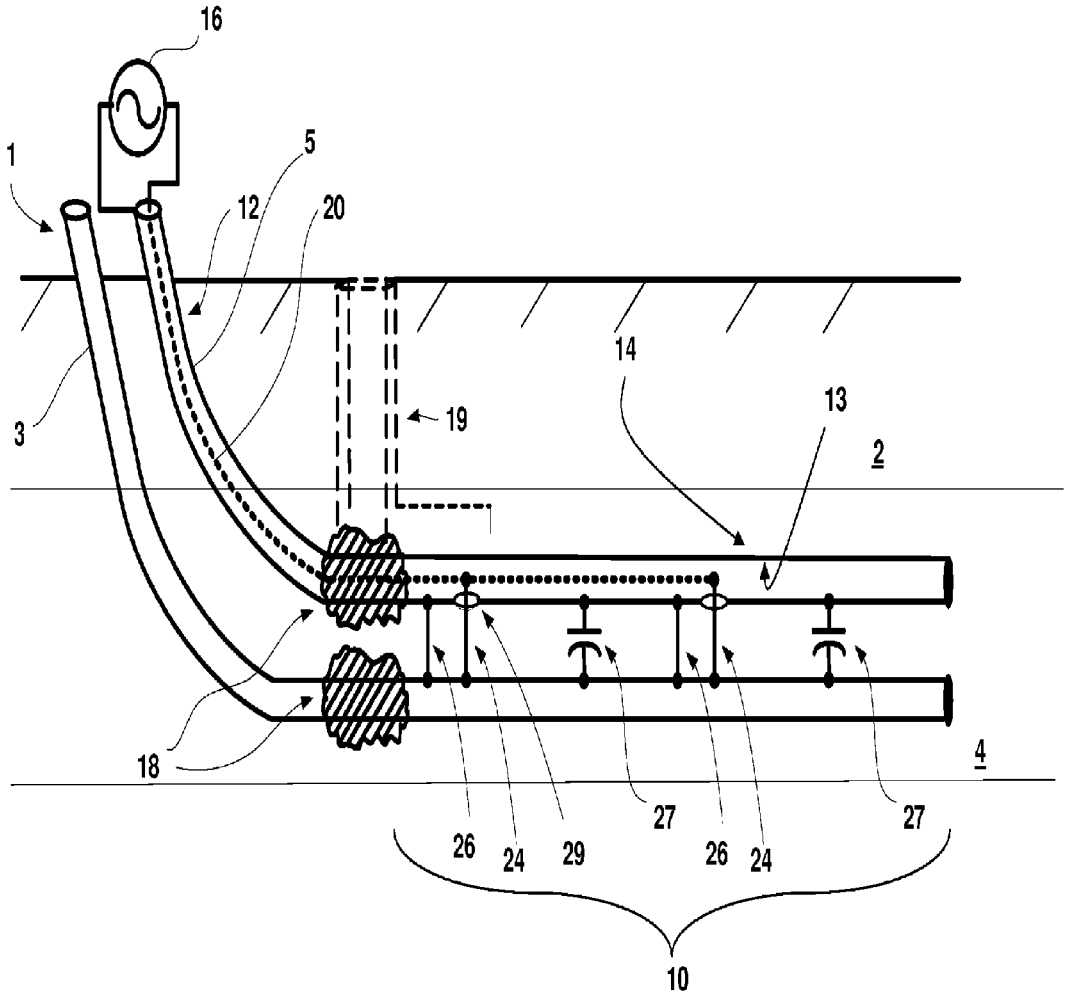
FIG. 1 is a diagrammatic cutaway view of an embodiment retrofitted to a steam assisted gravity drainage process in a hydrocarbon formation.

FIG. 1 shows an embodiment of the present invention made by retrofitting a steam assisted gravity drainage (SAGD) system generally indicated as 1. An SAGD system is a system for extracting heavy hydrocarbons. It includes at least two well pipes 3 and 5 that extend downward through an overburden region 2 into a hydrocarbon region 4. The portions of the steam injection pipe 5 and the extraction pipe 3 within the hydrocarbon formation 4 are positioned so that the steam or liquid released from the vicinity of the steam injection pipe 5 heats hydrocarbons in the hydrocarbon region 4, so the hydrocarbons flow to the extraction pipe 3. To accomplish this, the pipes generally contain perforations or slots, and the portions of the steam injection pipe 5 and the extraction pipe 3 within the hydrocarbon formation 4 commonly are generally parallel and lie at least generally in the same vertical plane. These relationships are not essential, however, particularly if the extracted oil does not flow vertically, for example, if it is flowing along a formation that is tilted relative to vertical. In a typical set up these pipes 3 and 5 can extend horizontally over one kilometer in length, and can be separated by 6 to 20 or more meters.

Alternatively to the above disclosure of placement of the pipes, if a steam extraction system has recovered oil, the arrangement of the system (regardless of its details) is contemplated to be operative for carrying out embodiments of the present development after modifying the system as disclosed here to inject electromagnetic energy. In accordance with this invention, electromagnetic radiation provides heat to the hydrocarbon formation, which allows heavy hydrocarbons to flow. As such, no steam is actually necessary to heat the formation, which provides a significant advantage especially in hydrocarbon formations that are relatively impermeable and of low porosity, which makes traditional SAGD systems slow to start. The penetration of RF energy is not inhibited by mechanical constraints, such as low porosity or low permeability. However, RF energy can be beneficial to preheat the formation prior to steam application.

Radio frequency (RF) heating is heating using one or more of three energy forms: electric currents, electric fields, and magnetic fields at radio frequencies. Depending on operating parameters, the heating mechanism may be resistive by joule effect or dielectric by molecular moment. Resistive heating by joule effect is often described as electric heating, where electric current flows through a resistive material. Dielectric heating occurs where polar molecules, such as water, change orientation when immersed in an electric field. Magnetic fields also heat electrically conductive materials through eddy currents, which heat resistively.

RF heating can use electrically conductive antennas to function as heating applicators. The antenna is a passive device that converts applied electrical current into electric fields, magnetic fields, and electrical current fields in the target material, without having to heat the structure to a specific threshold level. Preferred antenna shapes can be Euclidian geometries, such as lines and circles. Additional background information on dipole antenna can be found at S. K. Schelkunoff & H. T. Friis, *Antennas: Theory and Practice*, pp 229-244, 351-353 (Wiley New York 1952). The radiation patterns of antennas can be calculated by taking the Fourier transforms of the antennas' electric current flows. Modern techniques for antenna field characterization may employ digital computers and provide for precise RF heat mapping.

Susceptors are materials that heat in the presence of RF energies. Salt water is a particularly good susceptor for RF heating; it can respond to all three types of RF energy. Oil sands and heavy oil formations commonly contain connate liquid water and salt in sufficient quantities to serve as a RF heating susceptor. For instance, in the Athabasca region of Canada and at 1 KHz frequency, rich oil sand (15% bitumen) may have about 0.5-2% water by weight, an electrical conductivity of about 0.01 s/m (siemens/meter), and a relative dielectric permittivity of about 120. As bitumen melts below the boiling point of water, liquid water may be a used as an RF heating susceptor during bitumen extraction, permitting well stimulation by the application of RF energy. In general, RF heating has superior penetration to conductive heating in hydrocarbon formations. RF heating may also have properties of thermal regulation because steam is a not an RF heating susceptor.

An aspect of the invention is an RF applicator that can be used, for example, to heat a geological formation. The applicator generally indicated at 10 includes a coaxial conductor 12 that includes an inner conductor 20 and an outer conductor pipe 5, a second conductor pipe 3, a radio frequency source 16, current chokes 18, inner conductor jumpers 24, outer conductor jumpers 26, and reactors 27.

The outer conductor pipe 5 and the second conductor pipe 3 can be typical pipes used to extract oil from a hydrocarbon formation 4. In the depicted embodiment, the outer conductor pipe 5 is the steam injection pipe 5 (which optionally can still be used to inject steam, if a second source of heat is desired during, or as an alternative to, RF energy treatment), and the second conductor pipe 3 is the extraction pipe 3. They can be composed of steel, and in some cases one or both of the pipes may be plated with copper or other nonferrous or conductive metal. The pipes can be part of a previously installed extraction system, or they can be installed as part of a new extraction system.

The RF source 16 is connected to the coaxial conductor 12 and is configured to apply a differential mode signal with a wavelength $\lambda$ (lambda) across the inner conductor 20 and the outer conductor pipe 5. The RF source 16 can include a transmitter and an impedance matching coupler.

The inner conductor 20 can be, for example, a pipe, a copper line, or any other conductive material, typically metal. The inner conductor 20 is separated from the outer conductor by insulative materials (not shown). Examples include glass beads, dielectric cylinders, and trolleys with insulating wheels, polymer foams, and other nonconductive or dielectric materials.

The inner conductor 20 is connected to the second conductor pipe 3 through at least one inner conductor jumper 24 beyond the current chokes 18, which allows current to be fed to the second conductor pipe 3. An aperture 29 can be formed to allow the projection of the inner conductor jumper 24 through the outer conductor pipe 5. Each inner conductor jumper 24 can be, for example, a copper pipe, a copper strap, or other conductive metal. Although only one inner conductor jumper 24 is necessary to form the applicator 10, one or more additional inner conductor jumpers 24 can be installed, which can allow the applicator 10 to radiate more effectively or with a uniform heating pattern by modifying current distribution along the well. If the operating frequency of the applicator is high enough, an additional inner conductor jumper 24 can be installed, for instance, at a distance of λ/2 (lambda/2) from another inner conductor jumper 24, although additional inner conductor jumpers 24 can be installed any distance apart. The desirable number of inner conductor jumpers 24 used can depend on the frequency of the signal applied and the length of the pipe. For example, for pipe lengths exceeding λ/2 (lambda/2), additional inner conductor jumpers 24 can improve the efficiency of the applicator 10. The inner conductor jumper 24 may run vertically or diagonally. A shaft 19 may be included as an equipment vault, and inner conductor jumpers 24 can be installed through such a shaft. However, the inner conductor jumper 24 may be installed with the aid of robotics, with trolley tools, a turret drill, an explosive cartridge, or other expedients.

A current choke 18 surrounds the outer conductor pipe 5 and is configured to choke current flowing along the outside of the outer conductor pipe 5. In the illustrated embodiment, the current choke 18 also surrounds the second conductor pipe 3 and is configured to choke current flowing along the outside of the second conductor pipe 3.

Figure 2:
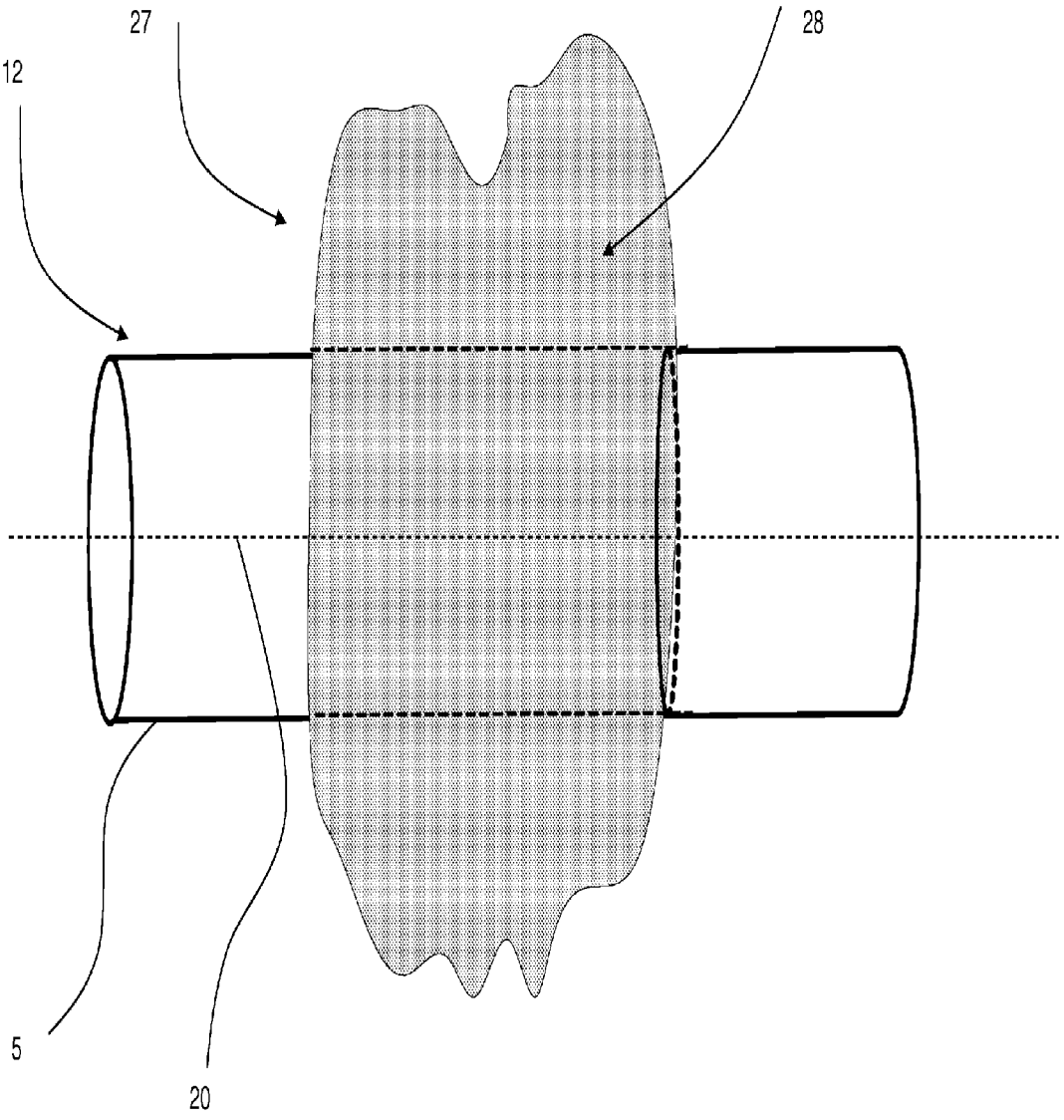
FIG. 2 is a diagrammatic perspective view of an embodiment of a current choke or antenna balun associated with a pipe.
Figure 3:
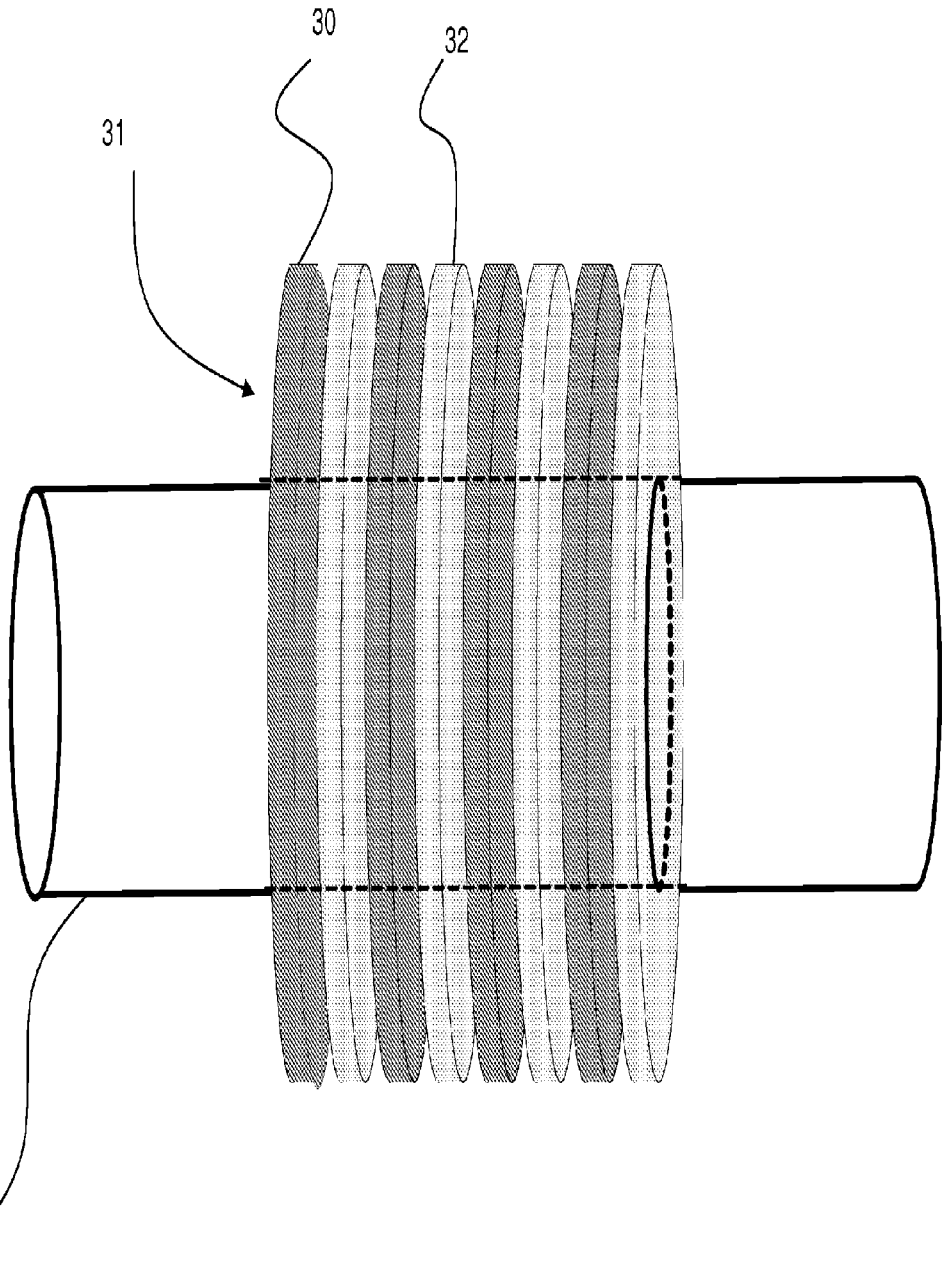
FIG. 3 is a diagrammatic perspective view of a current choke or antenna balun associated with a pipe.

The function of the current choke 18 can also be carried out or supplemented by providing independent current chokes that surround the outer conductor pipe 5 and the second conductor pipe 3 respectively. FIGS. 2 and 3 depict current chokes that surround a single conductor pipe. For example, the magnetic medium current choke 27 depicted in FIG. 2 can be installed around the outer conductor pipe 5, and the ring current choke 31 depicted in FIG. 3 can be installed around the second conductor pipe 3. Any combination of similar or different current chokes may be installed around either the outer conductor pipe 5 or the second conductor pipe 3. Thus, the current choke 18 can include two separate formations of magnetic material on conductor pipes 3 and 5, or the current choke 18 may be a single continuous formation encompassing both pipes 3, 5. Possible current chokes are described further with respect to FIGS. 2, 3, and 4 below.

FIG. 1 also depicts optional parts of the applicator 10 including outer conductor jumpers 26 and reactors 27. The outer conductor pipe 5 can be connected to the second conductor pipe 3 through one or more outer conductor jumpers 26 beyond the current choke 18. Each outer conductor jumper 26 can be, for example, a copper pipe, a copper strap, or other conductive material, typically metal. Each outer conductor jumper 26 can be paired with an inner conductor jumper 24, and for good results they can be spaced relatively close together, for instance, at a distance of 0.05λ (lambda/20) apart. However, they can be spaced closer or further apart, and better results can be obtained by varying the spacing depending, for instance, on the composition of a particular hydrocarbon formation.

Reactors 27 can be installed between the outer conductor pipe 5 and the second conductor pipe 3 beyond the current choke 18. Although capacitors are depicted in FIG. 1, it is understood that a reactor 27 may be an inductor, a capacitor, or an electrical network. Any commercially available reactor can be used and can be installed, for instance, by a robot or by digging a shaft to the appropriate location. The capacitance or inductance chosen can be based on the impedance matching or power factor needed, which can depend on the composition of a particular hydrocarbon formation. Capacitors can be installed in more conductive formations to reduce the inductive current loops that can form in such formations. Less conductive formations with high electrical permittivity can benefit from an inductor as a reactor 27. The large size of SAGD well systems means that low electrical load resistances can occur, and although impedance matching can be performed at the surface, the reactor 27 advantageously reduces the amount of circulating energy through the coaxial cable 12, minimizing conductor losses and material requirements.

The following is a discussion of the theory of operation of the embodiment of FIG. 1. This theory is provided to explain how the embodiment is believed to work, but the scope and validity of the claims are not limited by the accuracy or applicability of the stated theory. The RF source 16 is configured to apply an electrical potential, for example, a differential mode signal, with a frequency f and a wavelength λ (lambda) to the coaxial conductor 12, which acts as a shielded transmission line to feed current to the exterior of the outer conductor pipe 5 and the second conductor pipe 3 within the hydrocarbon region 4. The signal applied to the inner conductor 20 is approximately 180 degrees out of phase with the signal applied to the outer conductor pipe 5. The outer conductor pipe 5 acts as an electromagnetic shield over the coaxial conductor 12 to prevent heating of the overburden, preferably at all frequencies applied.

Although the signal above has been defined with regard to wavelength, it is common to define oscillating signals with respect to frequency. The wavelength λ (lambda) is related to the frequency f of the signal through the following equation:

$$f = \frac{c}{\lambda\sqrt{\varepsilon_r \mu_r}},$$

where c is equal to the speed of light or approximately $2.98\times 10^8$ m/s. $\in_r$ (epsilon) and $\mu_r$ (mu) represent the dielectric constant and the magnetic permeability of the medium respectively. Representative values for $\in_r$ and $\mu_r$ within a hydrocarbon formation can be 100 and 1, although they can vary considerably depending on the composition of a particular hydrocarbon formation 4 and the frequency. Many variations for the frequency of operation are contemplated. At low frequencies, the conductivity of the hydrocarbon formation can be important as the applicator provides resistive heating by joule effect. The joule effect resistive heating may be by current flow due to direct contact with the conductive antenna, or it may be due to antenna magnetic fields that cause eddy currents in the formation, which dissipate to resistively heat the hydrocarbon formation 4. At higher frequencies the dielectric permittivity becomes more important for dielectric heating or for resistive heating by displacement current. The present invention has the advantage that one energy or multiple energies may be active in a given system, so the heating system may be optimized at least partially for a particular formation to produce optimum or better results.

An advantage of this invention is that it can operate in low RF ranges, for example, between 60 Hz and 400 kHz. The invention can also operate within typical RF ranges. Depending on a particular hydrocarbon formation, one contemplated frequency for the applicator 10 can be 1000 Hz. It can be advantageous to change the operating frequency as the composition of the hydrocarbon formation changes. For instance, as water within the hydrocarbon formation is heated and desiccated (i.e. absorbed and/or moved away from the site of heating), the applicator 10 can operate more favorably in a higher frequency range, for increased load resistance. The depth of heating penetration may be calculated and adjusted for by frequency, in accordance with the well known RF skin effect. Other factors affecting heating penetration are the spacing between the outer conductor pipe 5 and the second conductor pipe 3, the hydrocarbon formation characteristics, and the rate and duration of the application of RF power.

Analysis and scale model testing show that the diameter of the outer conductor pipe 5 and the second conductor pipe 3 are relatively unimportant in determining penetration of the heat into the formation. Vertical separation of the outer conductor pipe 5 and the second conductor pipe 3 near more conductive overburden regions and bottom water zones can increase the horizontal penetration of the heat. The conductive areas surrounding the hydrocarbon region 4 can be conductive enough to convey electric current but not so conductive as to resistively dissipate the same current, allowing the present invention to advantageously realize boundary condition heating (as the bitumen formations are horizontally planar, and the boundaries between materials horizontally planar, the realized heat spread is horizontal following the ore).

The coaxial conductor 12 is believed to be able to act as both the transmission line feeding the applicator 10 and as a radiating part of the applicator 10 due to the RF skin effect. In other words, two currents flow along the outer conductor pipe 5 in opposite directions; one on the inside surface 13 of the outer conductor pipe 5 and one on the outside surface 14 of the outer conductor pipe 5. Thus, the RF skin effect is understood to allow current to be fed along the inside of the outer conductor pipe 5 to power the applicator 10, which causes current to flow in the opposite direction along the outside of the outer conductor pipe 5.

The current flowing along the inner conductor 20 is fed to the second conductor pipe 3 through an inner conductor jumper 24, and together with the current flowing along the outside of the outer conductor pipe 5, the antenna renders distributions of electric currents, electric fields, and magnetic fields in the hydrocarbon formation 4, each of which has various heating effects depending on the hydrocarbon formation's electromagnetic characteristics, the frequency applied, and the antenna geometry.

The current chokes 18 allow the electromagnetic radiation to be concentrated between the outer conductor pipe 5 and the second conductor pipe 3 within the hydrocarbon region 4. This is an advantage because it is desirable not to divert energy by heating the overburden region 2 which is typically more conductive. The current choke 18 forms a series inductor in place along the pipes 3, 5, having sufficient inductive reactance to suppress RF currents from flowing on the exterior of pipes 3, 5, beyond the physical location of the current choke 18. That is, the current choke 18 keeps the RF current from flowing up the pipes into the overburden region 2, but it does not inhibit current flow and heating on the electrical feed side of the choke. Currents flowing on the interior of outer conductor pipe 5 associated with the coaxial transmission line 12 are unaffected by the presence of current choke 18. This is due to the RF skin effect, conductor proximity effect, and in some instances also due to the magnetic permeability of the pipe (if ferrous, for example). At radio frequencies electric currents can flow independently and in opposite directions on the inside and outside of a metal tube due to the aforementioned effects.

Therefore, the hydrocarbon region 4 between the pipes is heated efficiently, which allows the heavy hydrocarbons to flow into perforations or slots (not shown) located in the second conductor pipe 3. In other words, the second conductor pipe 3 acts as the extraction pipe as it does in a traditional SAGD system.

Outer conductor jumpers 26 and reactors 27 can be used to improve the operation of the applicator 10 by adjusting the impedance and resistance along the outer conductor pipe 5 and the second conductor pipe 3, which can reduce circulating energy or standing wave reflections along the conductors. In general, outer conductor jumpers 26 are moved close to inner conductor jumpers 24 to lower load resistance and further away to raise load resistance. In highly conductive hydrocarbon formations 4, the outer conductor jumpers 26 can be omitted. Antenna current distributions are frequently unchanged by the location of the electrical drive, which allows the drive location to be selected for preferred resistance rather than for the heating pattern or radiation pattern shape.

FIG. 2 depicts an embodiment of a current choke 27. In this embodiment, the current choke 27 is an RF current choke or antenna balun. The magnetic medium of current choke 27 comprises a charge of magnetic medium 28 including a magnetic material and a vehicle. The magnetic material can be, for example, nickel zinc ferrite powder, pentacarbonyl E iron powder, powdered magnetite, iron filings, or any other magnetic material. The vehicle can be, for example, silicone rubber, vinyl chloride, epoxy resin, or any other binding substance. The vehicle may also be a cement, such as portland cement, which can additionally seal the well casings for conductor pipes 3 and 5 into the underground formations while simultaneously containing the magnetic medium 28. Another embodiment includes an apparatus and method for installing such a current choke, which will be described below with respect to FIGS. 6, 7, 8, and 9.

Referring to the FIG. 2 embodiment of the current choke 27, a theory of materials comprising the choke 27 will be described. The charge of magnetic material 28 should have a high magnetic permeability and a low electrical conductivity. The strongly magnetic elements are mostly good conductors of electricity such that eddy currents may arise at radio frequencies. Eddy currents are controlled in the present invention by implementing insulated microstructures. That is, many small particles of the magnetic material are used, and the particles are electrically insulated from each other by a nonconductive matrix or vehicle. The particle size or grain size of the magnetic material is about one RF skin depth or less. The particles of the magnetic medium 28 may optionally include an insulative surface coating (not shown) to further increase the bulk electrical resistivity of the current choke formation, or to permit the use of a conductive vehicle between the particles.

A theory of operation for the current choke 27 will now be described. A linear shaped conductor passing through a body of magnetic material is nearly equivalent to a 1 turn winding around the material. The amount of magnetic material needed for current choke 27 is that amount needed to effectively suppress RF currents from flowing into the overburden region 2, while avoiding magnetic saturation in the current choke material, and it is a function of the magnetic material permeability, frequency applied, hydrocarbon formation conductivity, and RF power level. The required inductive reactance from current choke 27 is generally made much greater than the electrical load resistance provide by the formation, for example, by a factor of 10. Present day magnetic materials offer high permeabilities with low losses. For instance, magnetic transformer cores are widely realized at 100 megawatt and even higher power levels. RF heated oil wells may operate at high current levels, relative to the voltages applied, creating low circuit impedances, such that strong magnetic fields are readily available around the well pipe to interact with the charge of magnetic medium 28.

FIG. 3 depicts another embodiment of a current choke, which can be implemented, for example, where lower frequencies will be used or in the case of new well construction. In this embodiment, the current choke operates as a common mode choke or antenna balun, as in previous embodiments. The ring current choke 31 includes alternating magnetic material rings 30 and insulator rings 32. The magnetic material rings 30 can be, for example, silicon steel. The insulator rings 32, can be any insulator, such as glass, rubber, or a paint or oxide coating on the magnetic material rings 30. FIG. 3 depicts a laminated assembly. The thickness of the laminations of magnetic material rings 30 may be about one (1) RF skin depth at the operating frequency of the antenna applicator 10. In silicon steel and at 60 Hz this can be about 0.25 to 0.5 mm, and at 1000 Hz about 0.075 to 0.125 mm (the skin depth varies as approximately $1/\sqrt{f}$). The current choke 31 may be made relatively flush to exterior of the pipe 14 by necking down the pipe in the vicinity or the rings or by other known methods. Although the current choke depicted in FIG. 3 is primarily directed here to RF heating of underground wells, it may also provide a versatile adaptation for controlling time varying current flowing along above ground pipelines.

Figure 4:
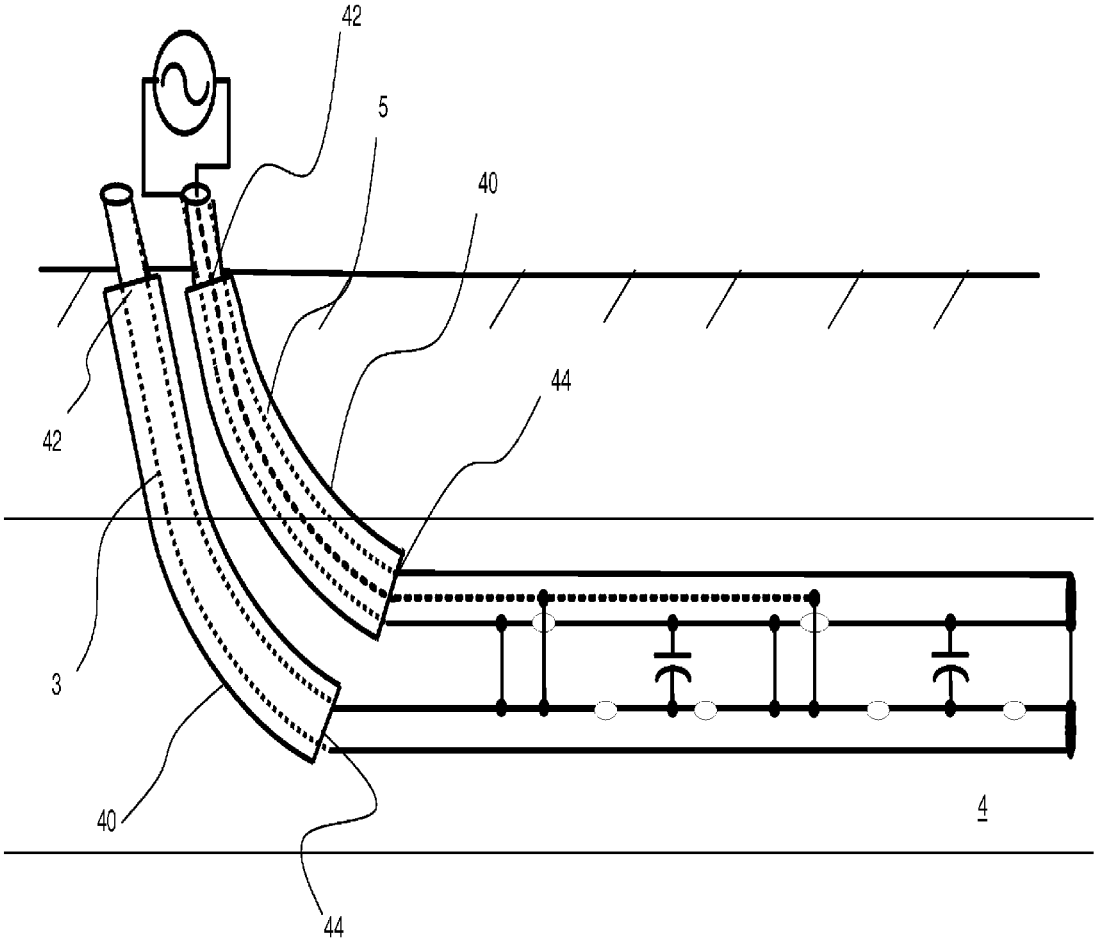
FIG. 4 is a view similar to FIG. 1 depicting yet another embodiment of the current choke including insulated pipe.

In yet other embodiments, for instance, at very low frequency or for direct current, the need for current choking can be satisfied by providing insulation on the exterior of the pipe. FIG. 4 depicts an embodiment including insulated pipe. In this embodiment insulation 40 is installed around the outer conductor pipe 5 and the second conductor pipe 3 through at least the overburden region 2, for example, from point 42 to point 44. The metal pipes are then exposed after point 44, which allows current to flow along the outside of the pipes within the hydrocarbon region 4.

Figure 5:
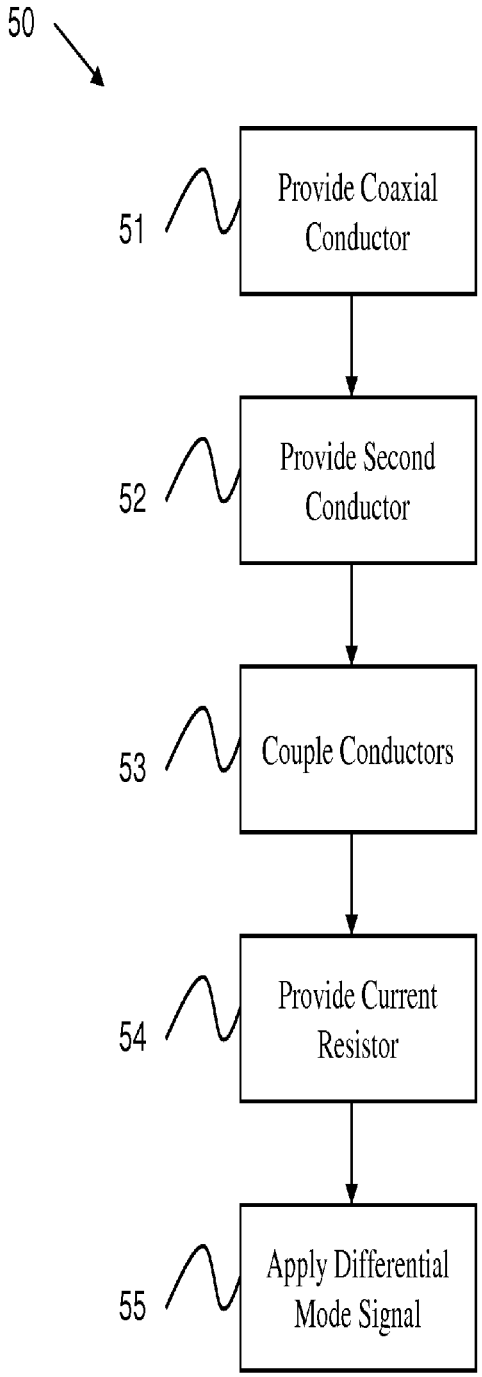
FIG. 5 is a flow diagram illustrating a method of applying heat to a hydrocarbon formation.

FIG. 5 depicts an embodiment of a method for heating a hydrocarbon formation 50. At the step 51, a coaxial conductor including an inner conductor and an outer conductor pipe is provided. At the step 52, a second conductor pipe is provided. At the step 53, the inner conductor is coupled to the second conductor pipe. At the step 54, a current choke positioned for choking current flowing along the outer conductor pipe and the second conductor pipe is provided. At the step 55, a differential mode signal is applied to the coaxial conductor.

At the step 51, a coaxial conductor including an inner conductor and an outer conductor pipe is provided. For instance, the coaxial conductor can be the same or similar to the coaxial conductor 12 of FIG. 1 including the inner conductor 22 and the outer conductor pipe 5. The outer conductor pipe 5 can be located within a hydrocarbon formation 4. The coaxial conductor can also be located near or adjacent to a hydrocarbon formation 4.

At the step 52, a second conductor pipe is provided. For instance, the second conductor pipe can be the same or similar to the second conductor pipe 3 of FIG. 1. The second conductor pipe can be located within a hydrocarbon formation 4. The second conductor pipe can also be located near or adjacent to a hydrocarbon formation 4.

At the step 53, the inner conductor can be coupled to the second conductor pipe. For instance, referring further to the example in FIG. 1, the inner conductor 20 is coupled to the second conductor pipe 3 through an inner conductor jumper 24.

At the step 54, a current choke can be positioned for choking current flowing along the outer conductor pipe and the second conductor pipe. For instance, referring further to the example in FIG. 1, current flowing along the outer conductor pipe 5 and the second conductor pipe 3 is choked by the current choke 18, which can be the same or similar to the current chokes or antenna baluns depicted in FIGS. 2 and 3, or the current can be choked through the use of insulated pipe as depicted in FIG. 4.

At the step 55, a differential mode signal is applied to a coaxial conductor that includes an inner conductor and an outer conductor. For instance, referring further to the example in FIG. 1, the RF source 16 is used to apply a differential mode signal with a wavelength $\lambda$ to the coaxial conductor 12.

Figure 6:
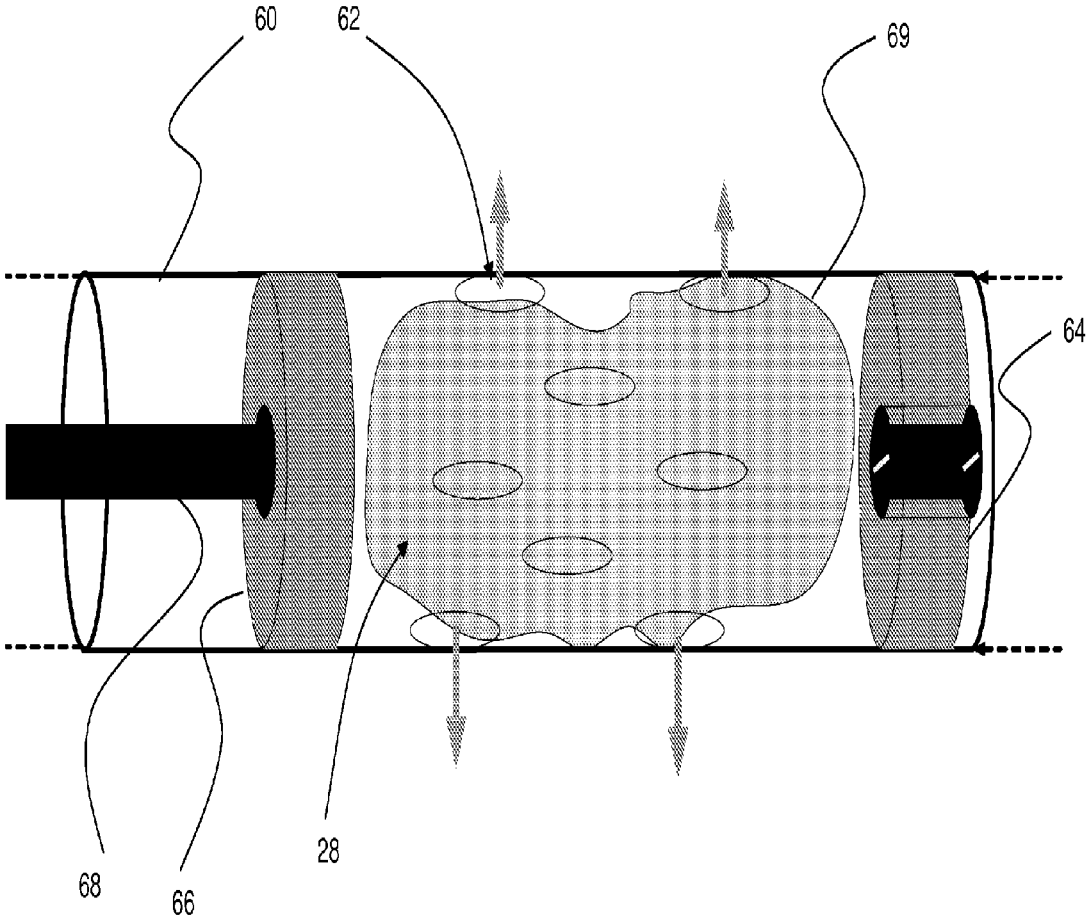
FIG. 6 is a diagrammatic perspective view of an apparatus for installing a current choke.

FIG. 6 depicts yet another embodiment. In this embodiment, an apparatus for installing a current choke is illustrated. The apparatus includes a tube 60 that contains at least one perforation 62, a plug 64 that is located within the tube beyond at least one perforation 62, a charge of magnetic medium 28 that is located at least partially within the tube 60 (at least initially) and adjacent to at least one perforation 62, and a piston 66 that is located within the tube 60 and adjacent to the charge of magnetic medium 28.

In an embodiment the tube 60 can be a pipe in an SAGD system. In such an embodiment, the perforations 62 can be the existing holes within the pipe that either allow steam to permeate the geological formation or provide collection points for the hydrocarbons. Thus, the apparatus depicted in FIGS. 6 and 7 and the methods illustrated in FIGS. 8 and 9 below allow a current choke to be installed around in an existing well pipe without having to dig a shaft down to the pipe.

The charge of magnetic medium 28 includes a magnetic material and a vehicle as described above in relation to an embodiment of the current choke 18 illustrated in FIG. 2. The compound that results from combining the magnetic material and the vehicle is a viscous, plastic semisolid or paste, such that it can be pushed out through a perforation 62. Additionally, the compound can be nonconductive, magnetically permeable, and/or environmentally inert. These characteristics make it a favorable material to use as a current choke or antenna balun within a geological formation.

The apparatus can also optionally include a container 69 that holds the charge of magnetic medium 28. The container 69 can be, for example, a porous or frangible bag that holds at least a portion of the charge of magnetic medium 28.

Figure 7:
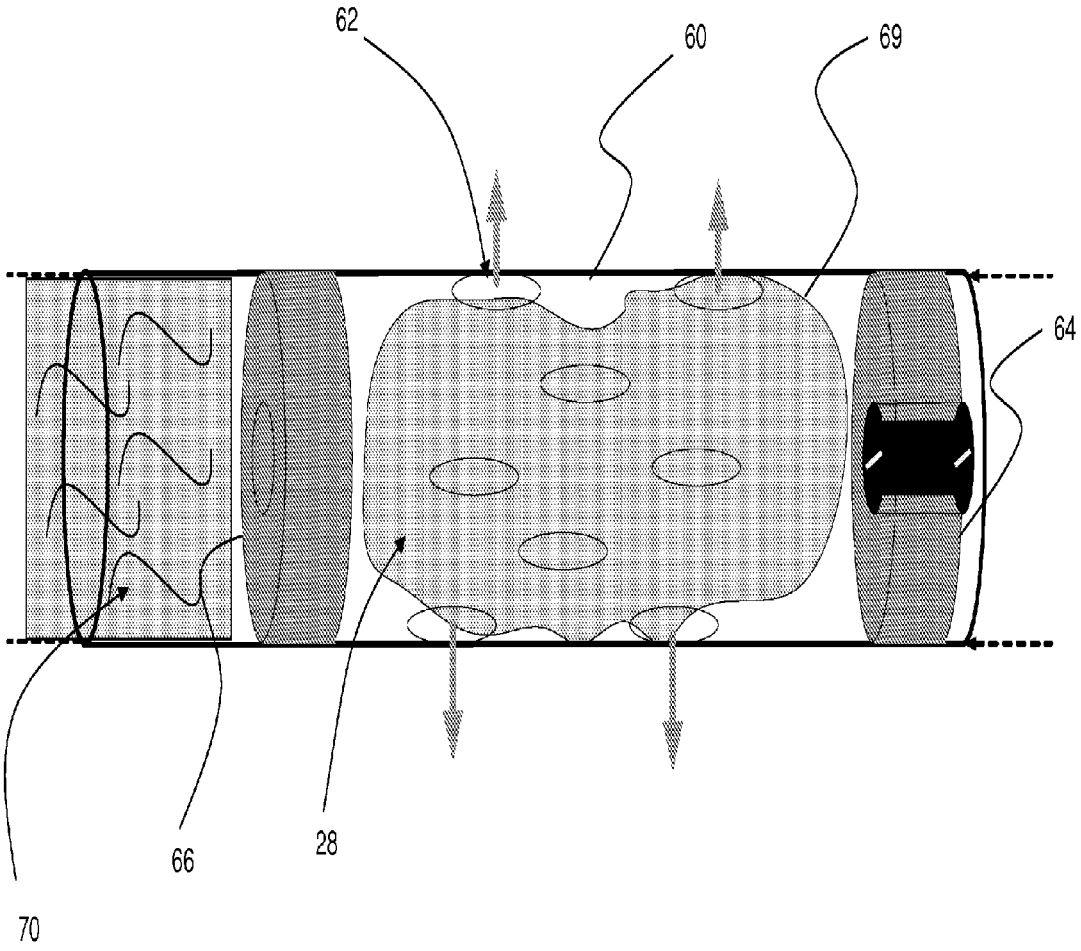
FIG. 7 is a diagrammatic perspective view of an apparatus for installing a current choke.

Various ways are contemplated of driving the apparatus illustrated in FIG. 6 to push the charge of magnetic medium 28 out through a perforation 62. FIG. 6 illustrates a pushrod 68 as the driver. In this embodiment, the pushrod 68 extends to the surface within the pipe 60. FIG. 7 depicts yet another embodiment of the apparatus for installing a current choke. In FIG. 7, the driver illustrated is compressed air 70, which can also be controlled and applied from the surface. There are other contemplated ways of driving the apparatus, such as pulling rather than pushing the piston 66 using a pushrod or flexible cable.

Figure 8:
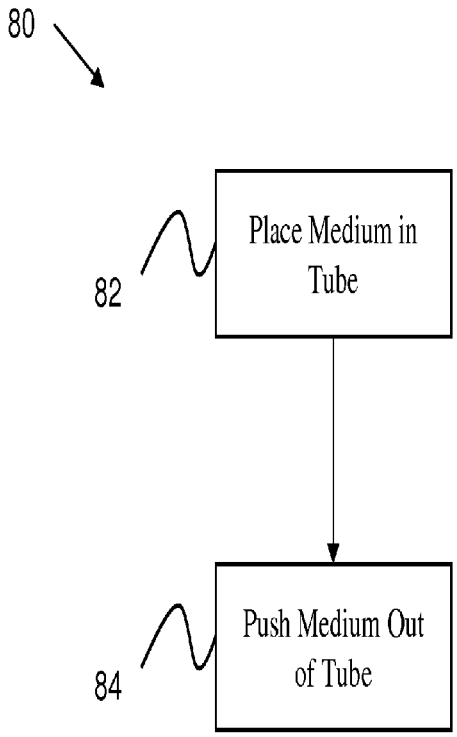
FIG. 8 is a flow diagram illustrating a method for installing a current choke.

FIG. 8 depicts another embodiment of a method for installing a current choke 80.

At the step 82, a charge of magnetic medium is placed within a tube having at least one perforation. For instance, the charge of magnetic medium can be the charge of magnetic medium 28 described above with regard to FIGS. 2, 6 and 7. The tube can be the same or similar to the tube 60 with one or more perforations 62, which can be a pipe with at least one hole in it. The pipe can further be a steam pipe or an extraction pipe in an SAGD system, which contains holes for the steam to escape from and the hydrocarbon to drain into, respectively.

At the step 84, the charge of magnetic medium is pushed out of the tube through at least one of the perforations. For instance, referring to FIGS. 6 and 7, the apparatuses illustrated can be used to push the charge of magnetic medium 28 out through the perforations 62.

Figure 9:
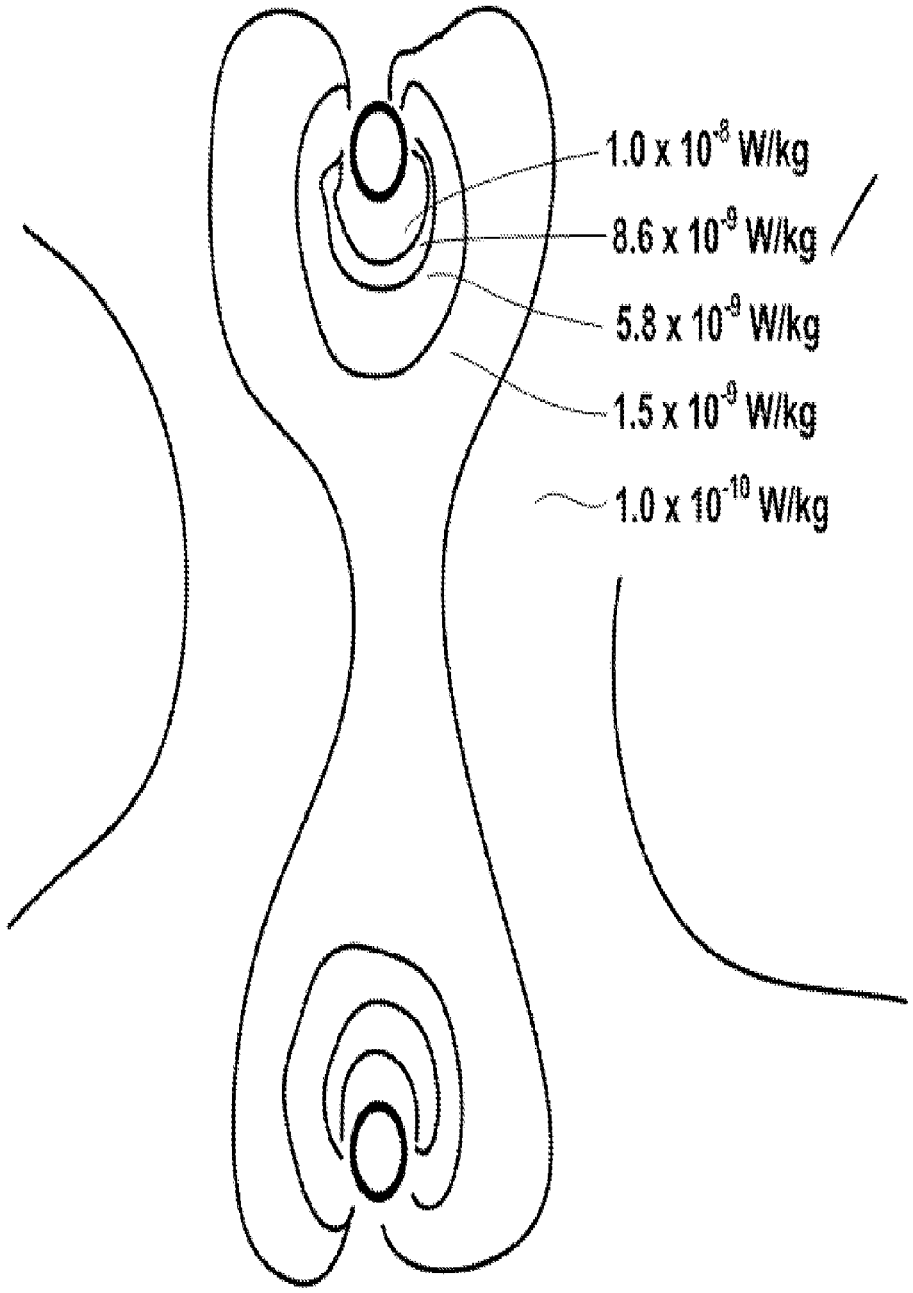
FIG. 9 is a representative RF heating pattern for a horizontal well pair according to the present invention.

A representative RF heating pattern in accordance with this invention will now be described. FIG. 9 depicts a cross sectional view of the RF heating pattern for a horizontal well pair according to the present invention. In the FIG. 9 view the well pipes are oriented into and out of the page. The heating pattern depicted shows RF heating only without steam injection, however, steam injection may be included if desired. Numerical electromagnetic methods were used to perform the analysis.

The FIG. 9 well dimensions are as follows: the horizontal well section is 731.52 meters long and at a depth of 198.12 meters, the iron well casings are spaced 20.0 meters apart vertically, applied power is 1 megawatt and the heat scale is the specific absorption rate in watts/kilogram. The pipe diameter is 12.7 cm. The heating pattern shown is for time t=0, for example, when the RF power is first applied. The frequency is 1000 Hz (which may provide increased load resistance over 60 Hz and is sufficient for penetrating many hydrocarbon formations). The formation was Athabasca oil sand and the conductivity of the pay zone was 0.0055 mhos/meter and there was a bottom water zone having a conductivity of 0.2 mhos/meter. As can be seen the instantaneous heating flux is concentrated at the opposing faces of the pipes and between the pipes. As time progresses captive steam bubbles form and the antenna magnetic fields can penetrate further into the formation extending the heating. The heating is durable and reliable as liquid water contact between the pipes and the formation is not required because operation is at radio frequencies where magnetic induction and electric displacement currents are effective. The heating pattern is relatively uniform along the well axis and the heat is confined to the production zone. At higher frequencies where the applicator 10 is large with respect to media wavelength, a sinusoidally varying heating pattern may form along the length of the well, in which case, the operating frequency may be varied over time to provide uniform temperatures in the hydrocarbon formation. The dielectric permittivity of hydrocarbon formations can greatly exceed that of pure liquid water at low frequencies due to electrochemical and interfacial polarization, and to ion sieving relating to the multiple components and the water in the pore spaces. The effect of high ore permittivity is that the ore captures electric fields within the hydrocarbon formation. The effect of the high over/underburden conductivity is that electric currents are spread along the hydrocarbon formation boundaries, such that a parallel plate heating applicator may form in situ. The connate water heats the hydrocarbons and sand grains by a factor of 100 or more due to the higher loss factor.

Although not so limited, heating from the present invention may primarily occur from reactive near fields rather than from radiated far fields. The heating patterns of electrically small antennas in uniform media may be simple trigonometric functions associated with canonical near field distributions. For instance, a single line shaped antenna, for example, a dipole, may produce a two petal shaped heating pattern due the cosine distribution of radial electric fields as displacement currents (see, for example, *Antenna Theory Analysis and Design*, Constantine Balanis, Harper and Roe, 1982, equation 4-20a, pp 106). In practice, however, hydrocarbon formations are generally inhomogeneous and anisotropic such that realized heating patterns are substantially modified by formation geometry. Multiple RF energy forms including electric current, electric fields, and magnetic fields interact as well, such that canonical solutions or hand calculation of heating patterns may not be practical or desirable.

One can predict heating patterns by logging the electromagnetic parameters of the hydrocarbon formation a priori, for example, conductivity measurements can be taken by induction resistivity and permittivity by placing tubular plate sensors in exploratory wells. The RF heating patterns are then calculated by numerical methods in a digital computer using method or moments algorithms such as the Numerical Electromagnetic Code Number 4.1 by Gerald Burke and the Lawrence Livermore National Laboratory of Livermore Calif.

Far field radiation of radio waves (as is typical in wireless communications involving antennas) does not significantly occur in antennas immersed in hydrocarbon formations 4. Rather the antenna fields are generally of the near field type so the flux lines begin and terminate on the antenna structure. In free space, near field energy rolls off at a $1/r^3$ rate (where r is the range from the antenna conductor) and for antennas small relative wavelength it extends from there to $\lambda/2\pi$ (lambda/2 pi) distance, where the radiated field may then predominate. In the hydrocarbon formation 4, however, the antenna near field behaves much differently from free space. Analysis and testing has shown that dissipation causes the rolloff to be much higher, about $1/r^5$ to $1/r^8$. This advantageously limits the depth of heating penetration in the present invention to substantially that of the hydrocarbon formation 4.

Thus, the present invention can accomplish stimulated or alternative well production by application of RF electromagnetic energy in one or all of three forms: electric fields, magnetic fields and electric current for increased heat penetration and heating speed. The RF heating may be used alone or in conjunction with other methods and the applicator antenna is provided in situ by the well tubes through devices and methods described.

Although preferred embodiments have been described using specific terms, devices, and methods, such description is for illustrative purposes only. The words used are words of description rather than of limitation. It is to be understood that changes and variations can be made by those of ordinary skill in the art without departing from the spirit or the scope of the present invention, which is set forth in the following claims. In addition, it should be understood that aspects of the various embodiments can be interchanged either in whole or in part. Therefore, the spirit and scope of the appended claims should not be limited to the description of the preferred versions contained herein.

The invention claimed is:

1. A method for applying heat to a hydrocarbon formation comprising:

providing a first coaxial conductor extending within a first one of a pair of wellbores within a subterranean formation and comprising an inner conductor, an outer conductor pipe, and a nonferrous plating coating the outer conductor pipe;

providing a second conductor pipe spaced from the outer conductor and extending within a second one of the pair of wellbores within the subterranean formation;

positioning a current choke adjacent at least one of the outer conductor pipe and the second conductor pipe to choke current flowing along an outer surface of the at least one of the outer conductor pipe and the second conductor pipe; and positioning at least one inner conductor jumper distal of the current choke relative to the RF source and connecting the inner conductor to the second conductor pipe.

2. The method of claim 1, further comprising injecting a gas susceptor into the outer conductor.

3. The method of claim 2, wherein the gas susceptor comprises steam.

4. The method of claim 1, further comprising injecting a liquid susceptor into the outer conductor.

5. An apparatus for installing a choke comprising:

an electrically conductive pipe having first and second ends and at least one sidewall defining a central bore, the at least one sidewall having at least one perforation therein;

a plug carried by the electrically conductive pipe distal, relative to the first end, from the at least one perforation;

a charge of a magnetic medium located at least partially within the electrically conductive pipe and adjacent to the at least one perforation;

a piston carried within the central bore of the electrically conductive pipe proximal, relative to the first end, from the charge of magnetic media and configured to slidably move through the central bore and to apply pressure on the charge of magnetic media to cause the charge of magnetic media to flow through the at least one perforation.

6. The apparatus of claim 5, wherein the electrically conductive pipe extends into a hydrocarbon formation.

7. The apparatus of claim 5, further comprising a container located within the tube and containing at least a portion of the magnetic medium.

8. The apparatus of claim 5, wherein the container comprises a frangible bag.

9. The apparatus of claim 5, further comprising a driver operatively connected to the piston for moving the piston.

10. The apparatus of claim 9, wherein the driver comprises a rod.

11. The apparatus of claim 9, wherein the driver comprises compressed air.

12. A method for installing a choke comprising:

placing a charge of a magnetic medium within an electrically conductive pipe having opposing first and second ends and at least one sidewall defining a central bore, the at least one sidewall having at least one perforation therein, and a plug located distal, relative to the first end, from the at least one perforation; and slidably moving a piston through the central bore to apply pressure to the magnetic material to cause the charge of the magnetic medium to flow through the at least one perforation, the piston being carried within the central bore proximal, relative to the first end, from the charge of the magnetic medium.

13. The method of claim 12, wherein the electrically conductive pipe extends into a hydrocarbon formation.

* * * * *